US006655924B2

(12) United States Patent
Ma

(10) Patent No.: US 6,655,924 B2
(45) Date of Patent: Dec. 2, 2003

(54) PERISTALTIC BUBBLE PUMP

(75) Inventor: Qing Ma, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/005,414

(22) Filed: Nov. 7, 2001

(65) Prior Publication Data

US 2003/0086790 A1 May 8, 2003

(51) Int. Cl.[7] ..... F04B 19/24
(52) U.S. Cl. ..... 417/209; 417/52; 417/53
(58) Field of Search ..... 417/209, 208, 417/207, 52; 413/53

(56) References Cited

U.S. PATENT DOCUMENTS

| | | | | |
|---|---|---|---|---|
| 5,375,979 A | * | 12/1994 | Trah | 417/52 |
| 6,007,302 A | * | 12/1999 | Welle | 417/52 |
| 6,062,681 A | * | 5/2000 | Field et al. | 347/65 |
| 6,071,081 A | * | 6/2000 | Shiraishi | 417/52 |
| 6,299,673 B1 | * | 10/2001 | Field et al. | 96/185 |

OTHER PUBLICATIONS

Jun et al., "Microscale Pumping with Traversing Bubbles in Microchannels", Solid–State Sensor and Actuator Workshop, Hilton Head Island, SC, Jun. 3–6, 1996.

TSAI et al., "A Thermal Bubble Actuated Micro Nozzle–Diffuser Pump", The 14$^{th}$ IEEE International Conference on Micro Electro Mechanical Systems, Interlaken, Switzerland, Jan. 21–25, 2001.

Rai–Choudhury, P., *Handbook of Mircolithography, Micromachining and Microfabrication, vol. 2: Micromachining and Microfabrication*, Co–published by SPIE—The International Society for Optical Engineering, Bellingham, WA, USA and by The Institution of Electrical Engineers, Stevenage, Herts. UK, pp. 421–427 (1997).

* cited by examiner

*Primary Examiner*—Charles G. Freay
*Assistant Examiner*—Michael K. Gray
(74) *Attorney, Agent, or Firm*—Charles K. Young

(57) ABSTRACT

A pump comprises a chamber with an inlet and an outlet. A first heating element is located in proximity with the inlet, and a second heating element is located in proximity with the outlet. The first and second heating elements are configured when heated to form a bubble within the chamber. By controlling the first and second heating elements, fluid is expelled from the pump.

18 Claims, 11 Drawing Sheets

PERISTALTIC BUBBLE PUMP

BACKGROUND OF THE INVENTION

1. Field of the Invention

The described invention relates to microfluidic structures. More specifically, it relates to the pumping of microfluidic structures using a peristaltic bubble pump.

2. Description of Related Art

Micro-electromechanical systems (MEMS) provide a technology that enables the miniaturization of electrical and mechanical structures. MEMS is a field created primarily in the silicon area, where the mechanical properties of silicon (or other materials such as aluminum, gold, etc.) are used to create miniature moving components. MEMS can also be applied to GaAs, quartz, glass and ceramic substrates.

An example of a MEMS device could be a small mechanical chamber where two liquids (biofluids, drugs, chemicals, etc.) are mixed and a sensor interprets the result. MEMS could also be integrated with logic functionalities i.e. having a CMOS circuit to perform some algorithm with the data provided by the sensor. The CMOS circuit could then have circuit elements that transport the results of the algorithm and the sensor input to another device.

One of the mechanical processes typically performed by MEMS is transporting small amounts of fluids through channels. One way to do this is through the use of a variety of mechanical and non-mechanical pumps.

Mechanical pumps include piezo-electric pumps and thermo pneumatic peristaltic pumps. These pumps typically use a membrane which, when pressure is exerted on the membrane, restricts or allows fluid flow as desired. These pump structures with membranes, however, are relatively complex to manufacture.

Non-mechanical pumps include electrokinetic pumps. Electrokinetic pumps use an ionic fluid and a current imposed at one end of the channel and collected at the other end of the channel. This current in the ionic fluid impels the ionic fluid towards the collection pad of the electrokinetic pump.

Another type of non-mechanical pump uses a thermal bubble to pump fluids through a microchannel. FIGS. 1A and 1B show a prior art example of a thermal bubble pump used to pump a fluid. A controllable heater (not shown) above the pump chamber 1 causes a bubble 4 to expand or shrink. A nozzle-shaped inlet 2 and a nozzle-shaped outlet 3 create a net flow from the inlet 2 to the outlet 3. FIG. 1A shows an example in which an expanding bubble 4 causes a net flow out of the main chamber 1 through the outlet 3. FIG. 1B shows an example in which a shrinking bubble 4 causes a net flow into the main chamber 1 through the inlet 2. The shape of the nozzle-shaped inlet 2 and outlet 3 bias the direction of fluid flow; however, the efficiency of the bubble pump is fairly low as a backflow through both the inlet 2 and outlet 3 occurs.

DETAILED DESCRIPTION

A method and apparatus for using a bubble peristaltic pump is described. The bubble peristaltic pump uses heating elements to regulate flow of fluid through a pump chamber by selectively blocking one or more inlets and/or outlets of the chamber.

Figure 1A:
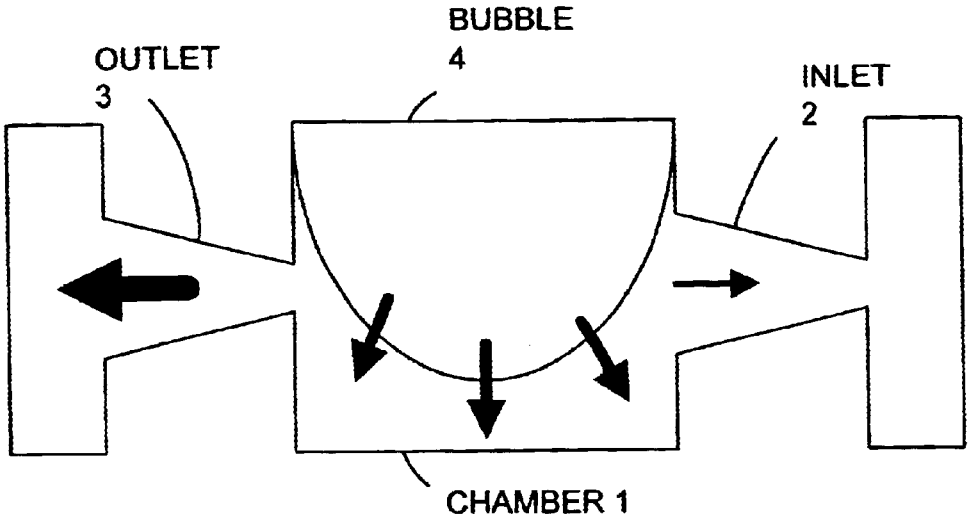
FIG. 1A (PRIOR ART)
FIGS. 1A and 1B show a prior art example of a thermal bubble used to pump a fluid.
Figure 1B:
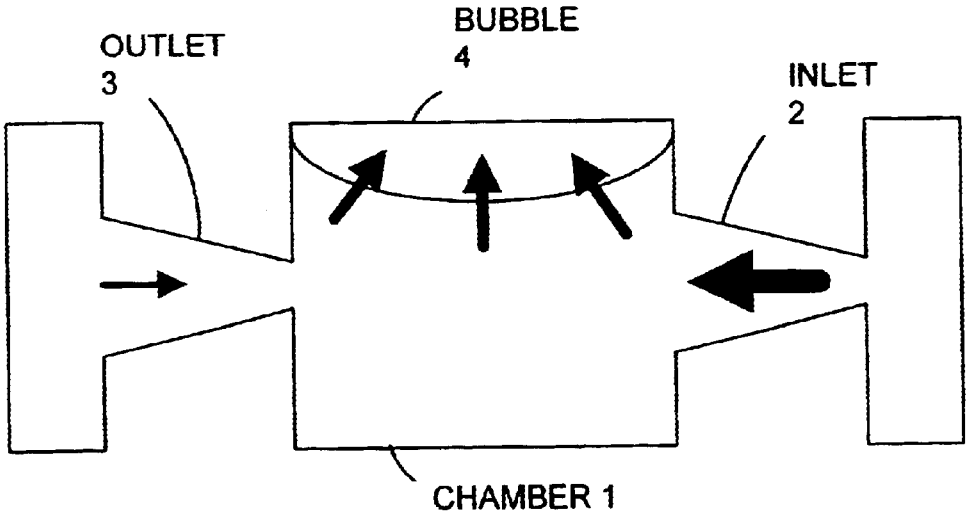
FIG. 1B (PRIOR ART)
Figure 2A:
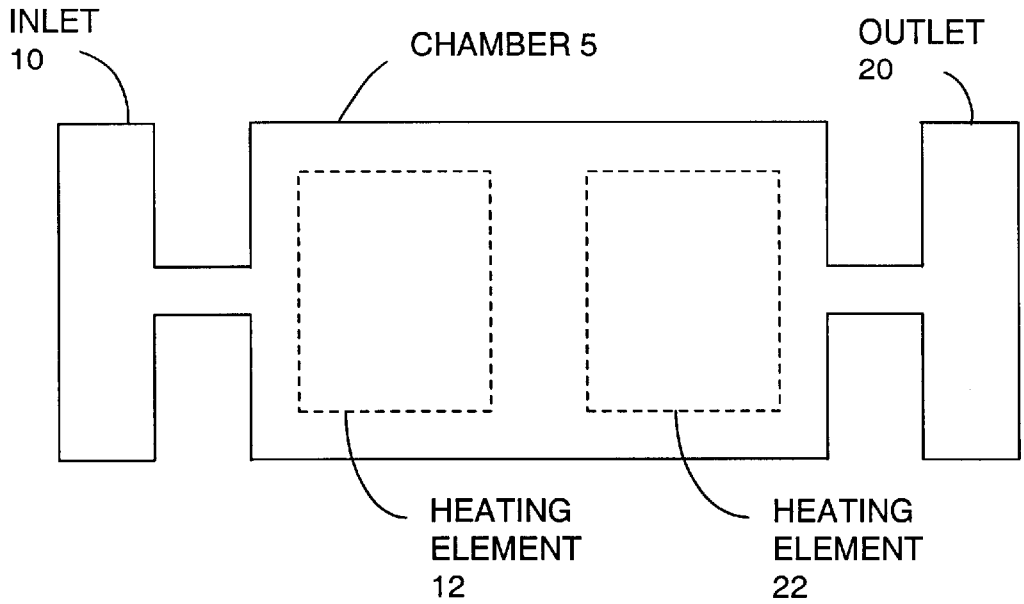
FIG. 2A is a block diagram showing one embodiment of a bubble peristaltic pump.

FIG. 2A is a block diagram showing one embodiment of a bubble peristaltic pump. The pump comprises a chamber 5 having an inlet 10 and an outlet 20. A first heating element 12 is located in proximity with the inlet 10, and a second heating element 22 is located in proximity with the outlet 20. The pump chamber 5 is filled with a fluid. The first and second heating elements 12, 22 are not active initially.

Figure 2B:
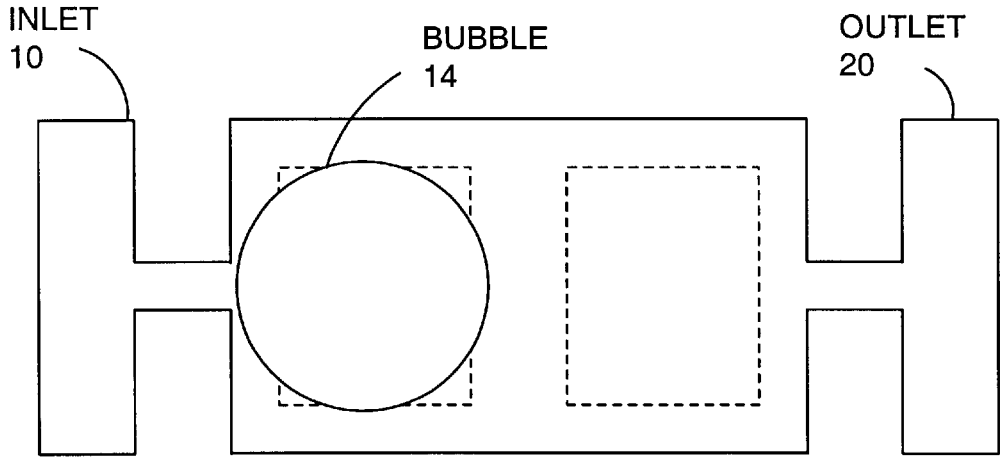
FIGS. 2B–2H show an example of pumping fluid through the structure of FIG. 2A by generating bubbles with heating elements.

FIGS. 2B–2F show an example of pumping fluid through the structure of FIG. 2A by generating bubbles with the heating elements 12, 22. FIG. 2B shows a first bubble 14 generated within the fluid by the first heating element 12 heating up. Fluid flows out both the inlet 10 and outlet 20 until the bubble 14 becomes large enough to block the inlet 10.

Figure 2C:
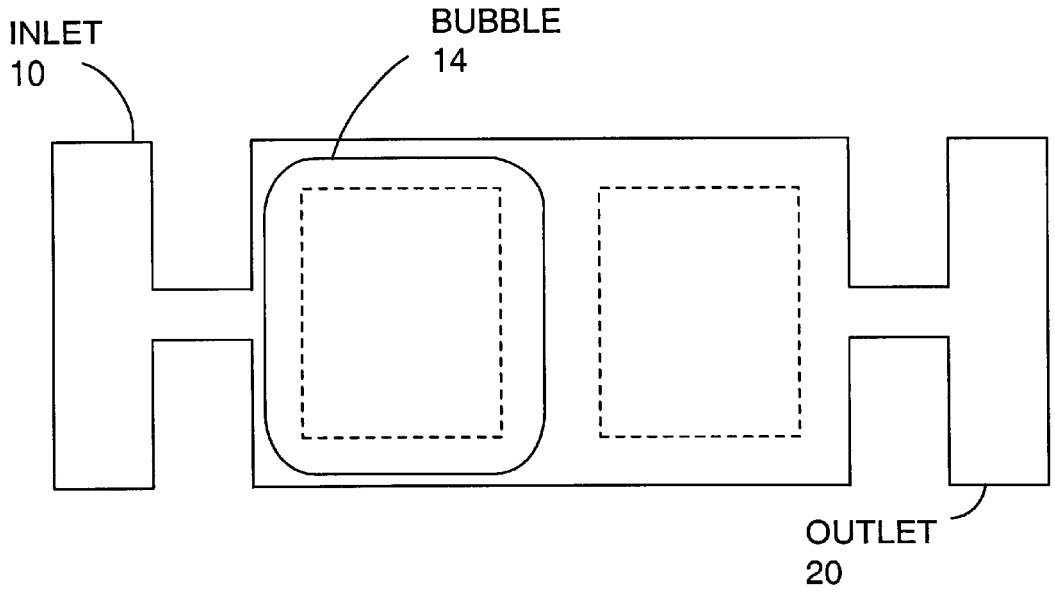

FIG. 2C shows the first bubble 14 expanded larger than just blocking the inlet 10. After the inlet 10 is blocked, as the first bubble 14 increases in size by the first heating element 12 continuing to heat the fluid, the fluid is expelled from the chamber 5 through the outlet 20.

Figure 2D:
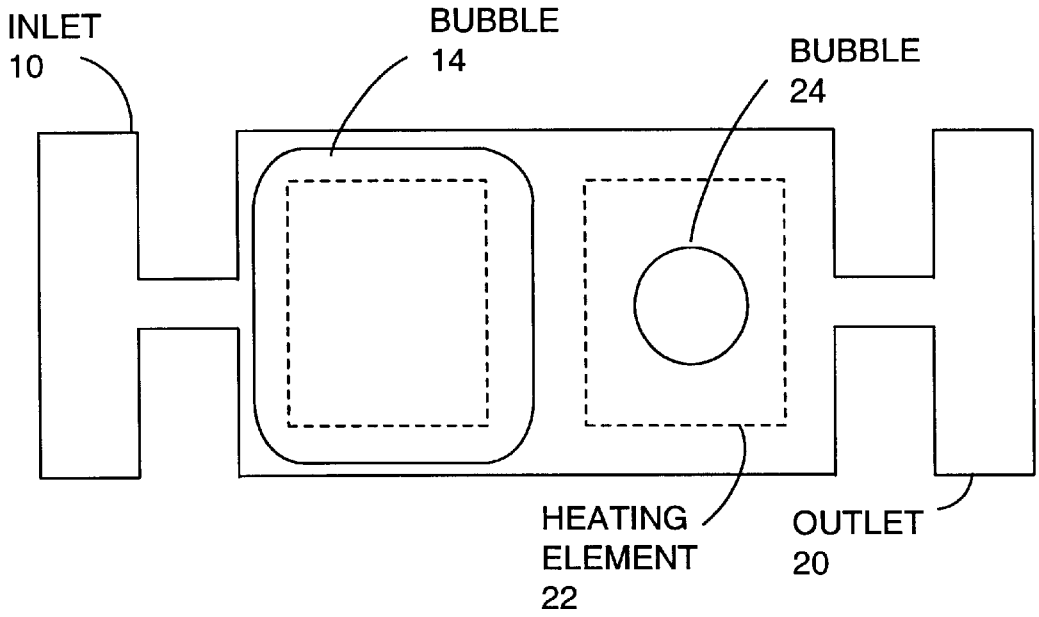

FIG. 2D shows the first bubble 14 being held approximately constant in size. This may be achieved by keeping the temperature of the heating element 12 at a fairly constant temperature. In one embodiment, a feedback mechanism may be employed to monitor the size of the bubble 14 or the flow of fluid through the chamber 5 and may adjust the heating elements accordingly. As the second heating element 22 heats up, a second bubble 24 is generated.

Figure 2E:
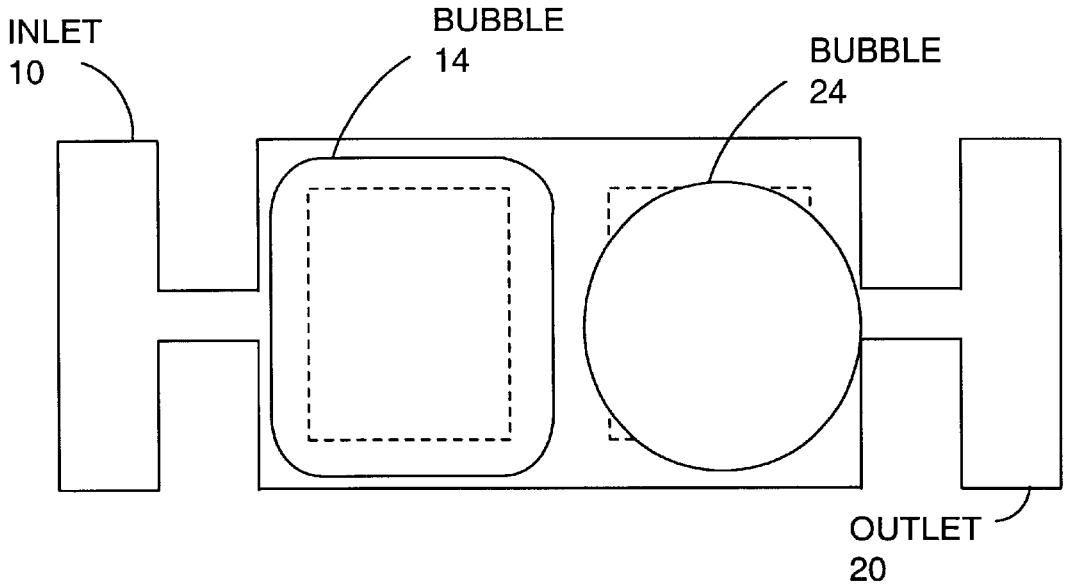

FIG. 2E shows the first bubble 14 still blocking the inlet 10, and a second bubble 24 expanding as the second heating element 22 heats up the fluid. As the second bubble 24 expands in size, fluid moves out of the chamber 5 through the outlet 20 until the second bubble 24 blocks the outlet 20.

Figure 2F:
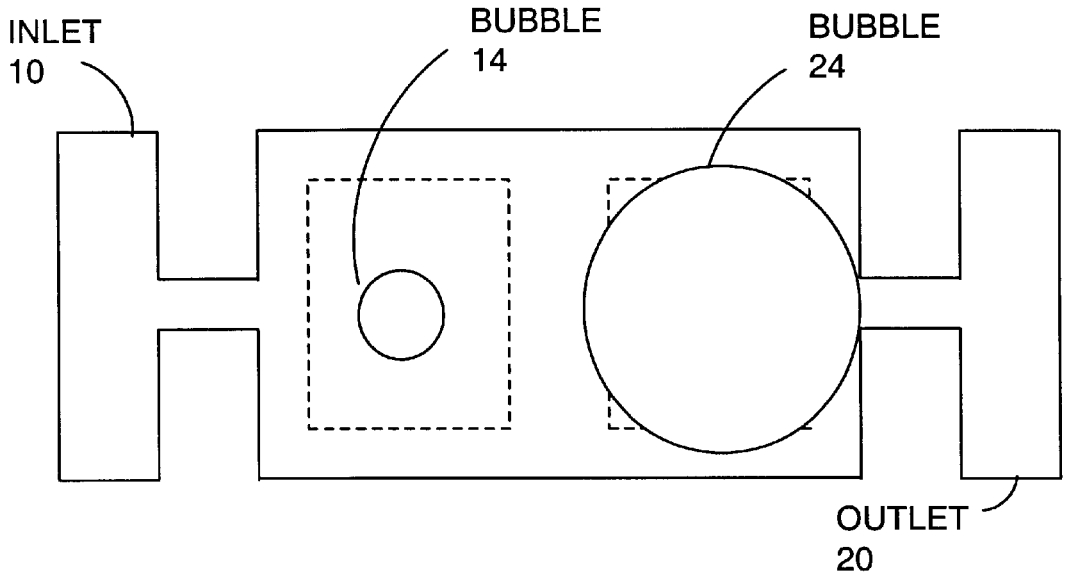

FIG. 2F shows the second bubble 24 still blocking the outlet 20, as the first bubble 14 is reduced in size by allowing the first heating element 12 to cool. Fluid is pulled in through the inlet to fill the void left from the shrinking first bubble 14.

Figure 2G:
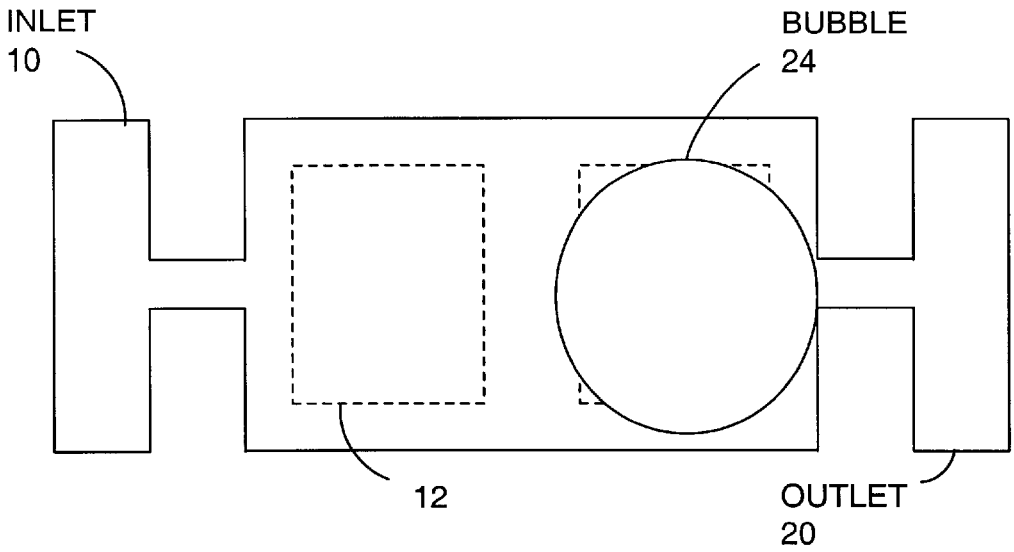

FIG. 2G shows the second bubble 24 still blocking the outlet 20. The first bubble 14 is eliminated by allowing the first heating element 12 to continue to cool. Fluid is pulled in through the inlet 10 to fill the void left from the shrinking first bubble 14 (no longer shown).

Figure 2H:
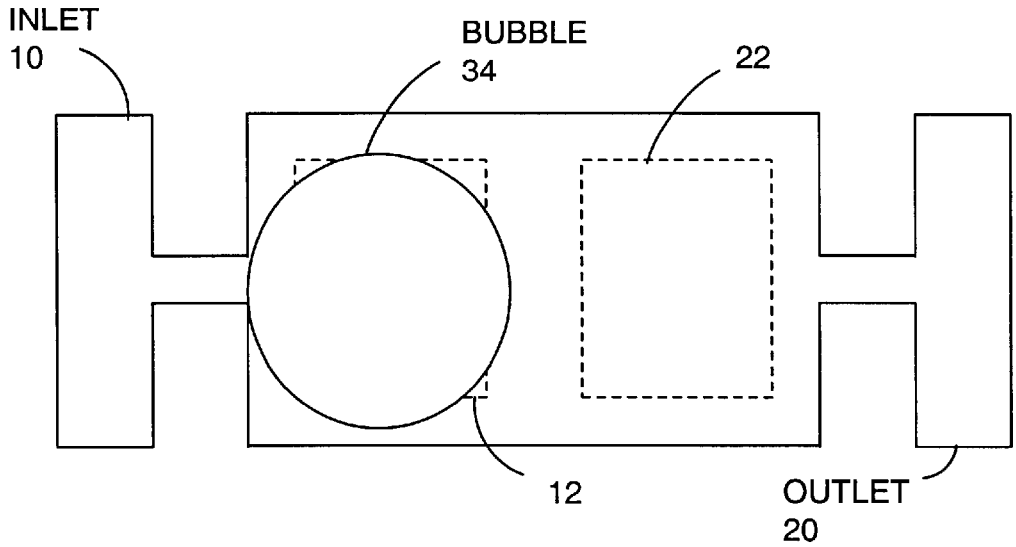

FIG. 2H shows a bubble 34 generated by the first heating element 12, and the bubble 24 (from FIG. 2G) is reduced in size or eliminated by allowing the second heating element 22 to cool. The bubble 34 expands to block the inlet 10, and the bubble 24 is reduced in size or eliminated to no longer block the outlet 20. As the bubble 34 expands, fluid is expelled from the chamber through the outlet 20. In one embodiment, bubble 34 is the same as the first bubble 14 which was never completely eliminated. In another embodiment, the first bubble 14 is completely eliminated after the first heating element 12 cools off, and a new bubble 34 is generated when the first heating element 12 heats up again. Similarly, bubble 24 may alternatively be reduced in size but not eliminated or vice versa. Additionally, it should be noted that a bubble formed by one element may combine with other bubbles formed by other heating elements, and the combined bubble may act in a similar fashion as that described with respect to the single bubbles associated with particular heating elements.

The process of expelling fluid from the chamber (described with respect to FIGS. 2C, 2D, 2E) and then refilling the chamber with new fluid (described with respect to FIGS. 2F, 2G) are then continually repeated to pump fluid through the chamber 5.

FIGS. 3A–3H show an example of using a structure having more than two heating elements to pump fluid from an inlet 110 to an outlet 120.

Figure 3A:
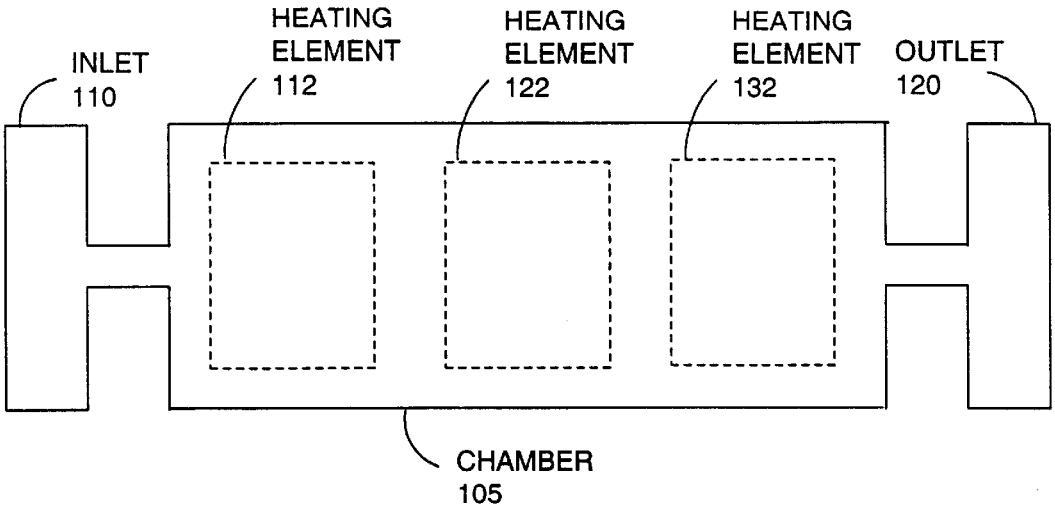
FIGS. 3A–3H show an example of using a structure having more than two heating elements to pump fluid from an inlet to an outlet.

FIG. 3A shows a chamber 105 that is filled with fluid. Within the chamber, there are three heating elements 112, 122, 132. A first heating element 112 is located in proximity of the inlet 110, a third heating element 122 is located in proximity of the outlet 120, and a second heating element is located between the first heating element 112 and the third heating element 132.

Figure 3B:
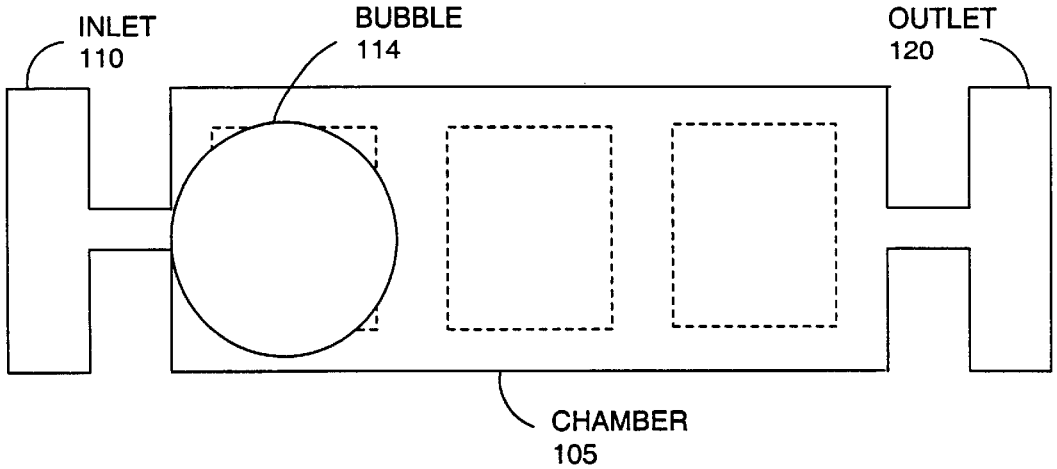

FIG. 3B shows a first bubble 114 generated by the first heating element 112. The first bubble 114 expands to block the inlet 110.

Figure 3C:
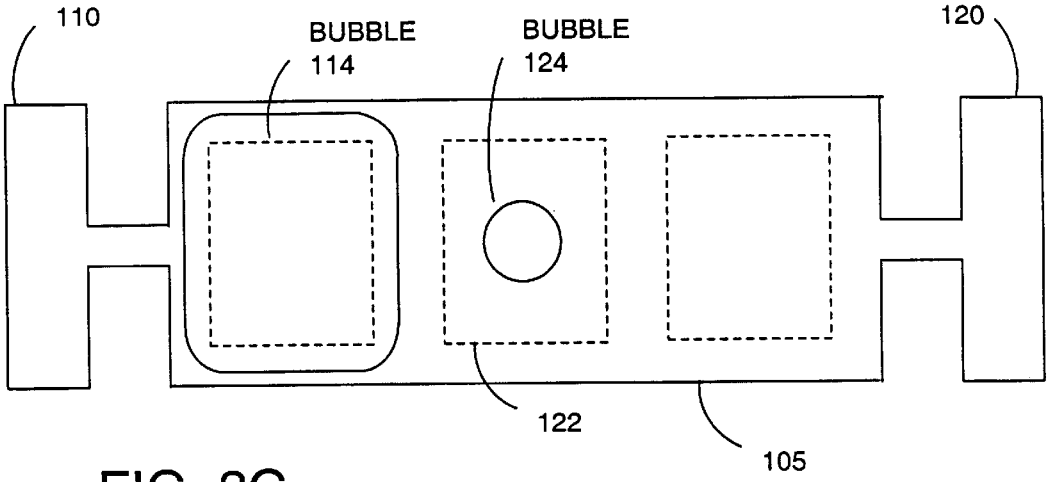

FIG. 3C shows the first bubble 114 expanding further, which expels fluid from the chamber 105 through the outlet 120. FIG. 3C also shows a second bubble 124 generated by a second heating element 122. As the bubble expands, fluid is expelled from the pump chamber 105. In one embodiment, the second heating element is calibrated to expand the second bubble 124 until the bubble 124 touches multiple walls of the chamber 105.

Figure 3D:
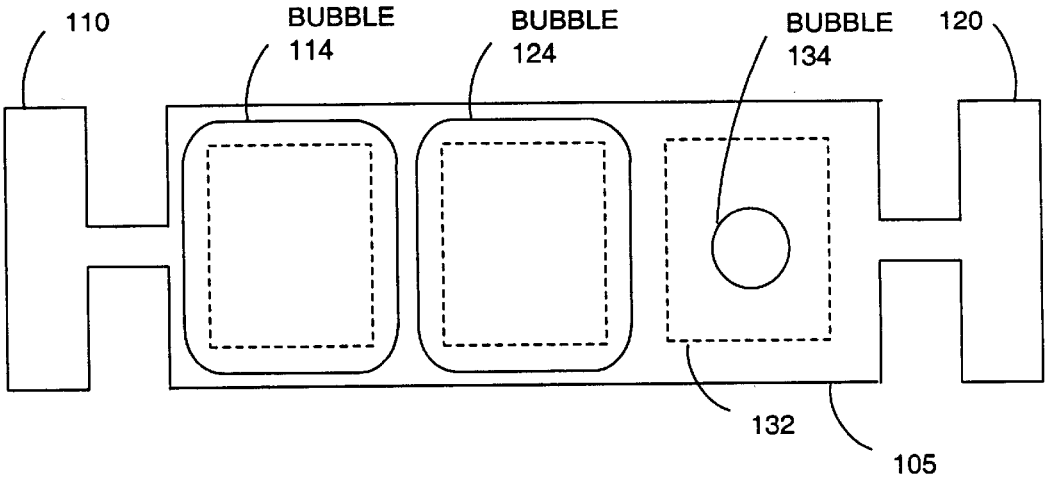

FIG. 3D shows the first bubble 114 and the second bubble 124 fully expanded. A third bubble 134 is generated by the third heating element 132 heating up. Fluid continues to be expelled as the bubbles 124, 134 continue to expand.

Figure 3E:
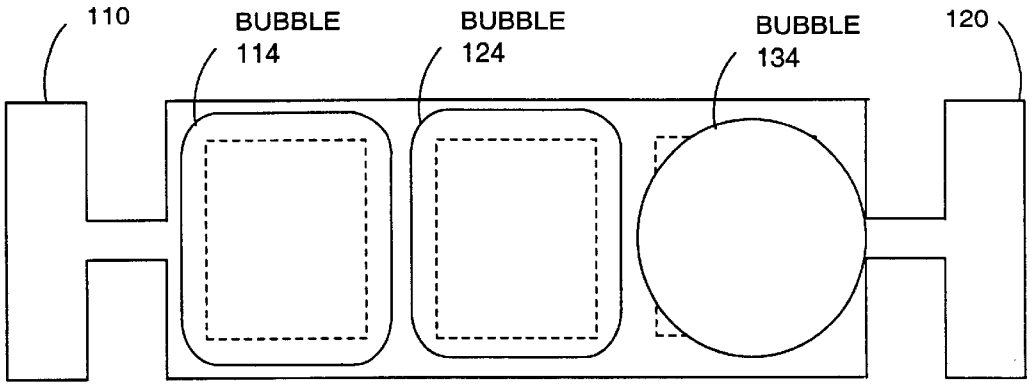

FIG. 3E shows the third bubble 134 blocking the outlet 120. Fluid is expelled from the pump chamber 105 until the third bubble 134 blocks the outlet 120.

Figure 3F:
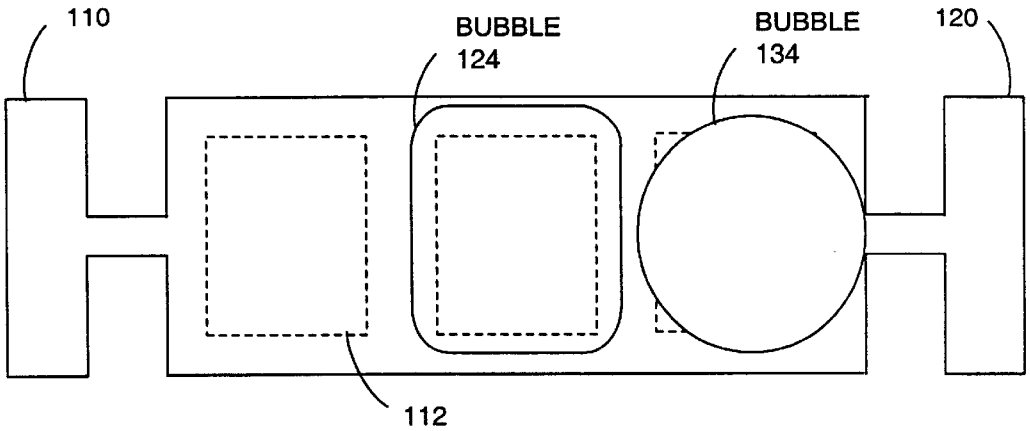

FIG. 3F shows the second and third bubbles 124, 134 being held at a relatively constant size, as the first bubble 114 is reduced in size or eliminated by allowing the first heating element 112 to cool. In one embodiment, the second and third bubbles 124, 134 are held at approximately the same size by keeping the temperature of the heating elements 122, 132 at a fairly constant temperature. In one embodiment, a feedback mechanism may be employed to monitor the size of the bubbles 124, 134 or the flow of fluid through the chamber and may adjust the heating elements accordingly.

Figure 3G:
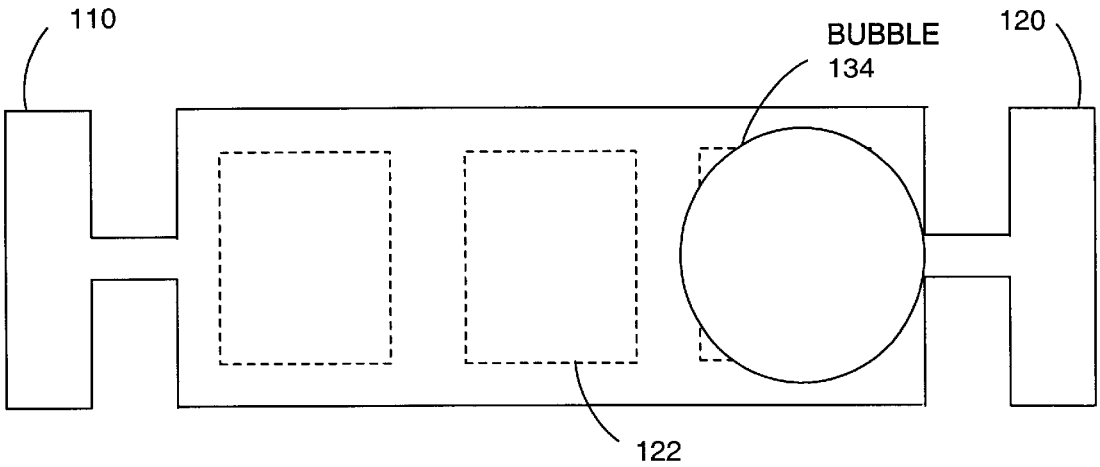

FIG. 3G shows the third bubble 134 being held at a relatively constant size, as the second bubble 124 is eliminated or reduced in size by allowing the second heating element 122 to cool.

Figure 3H:
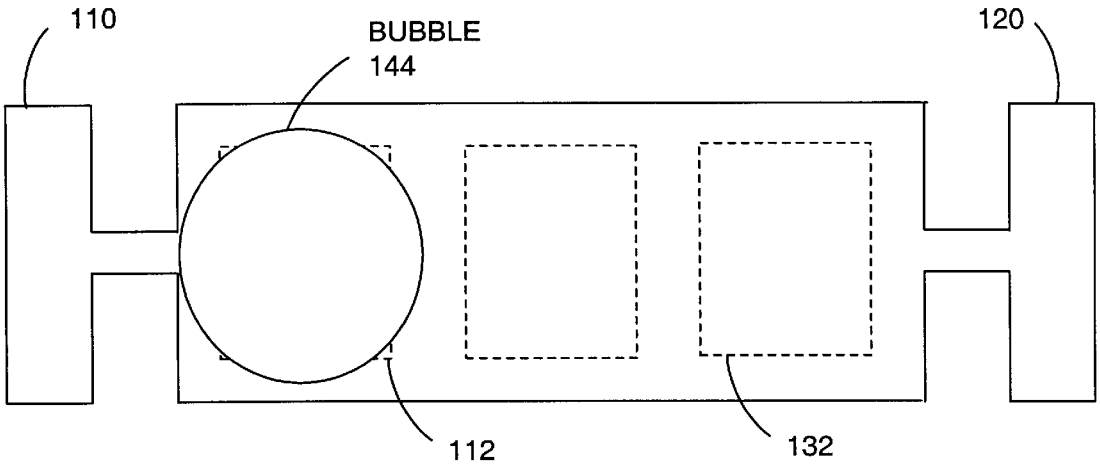

FIG. 3H shows a bubble 144 generated by the first heating element 112 heating up, as the third bubble 134 is eliminated or reduced in size by allowing the third heating element 132 to cool. The bubble 144 blocks the inlet 110 and further expansion of bubble 144 expels fluid through the outlet 120.

The process of expelling fluid from the chamber 105 (described with respect to FIGS. 3C, 3D, 3E) and then refilling the chamber 105 with new fluid (described with respect to FIGS. 3F, 3G) are then continually repeated to pump fluid through the chamber 105.

Figure 4:
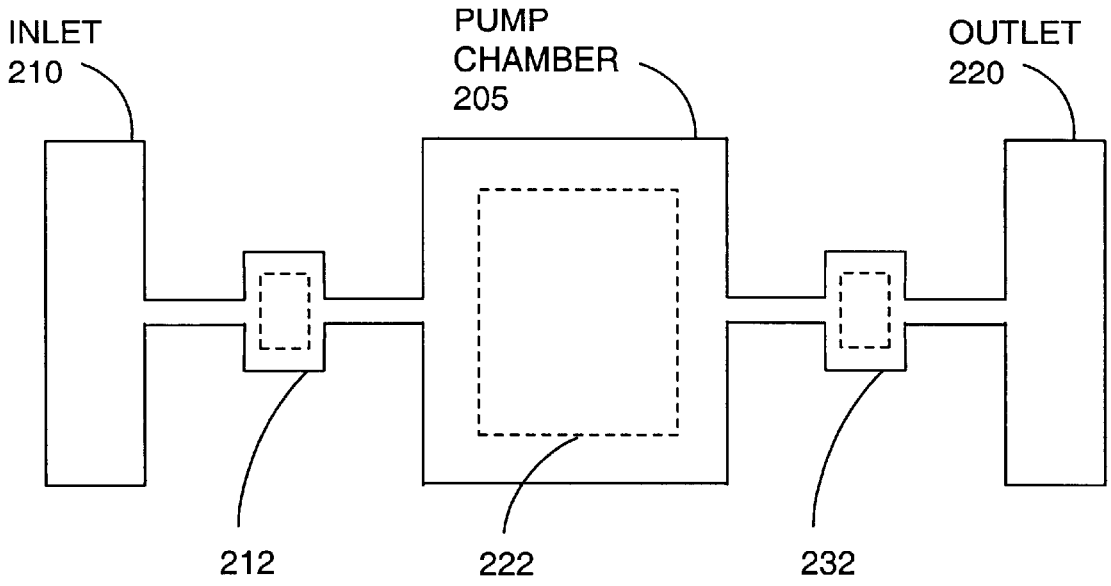
FIG. 4 is a schematic diagram that shows another embodiment of a pump that uses multiple heating elements to pump fluid from an inlet through a pump chamber and out through an outlet.

FIG. 4 is a schematic diagram that shows another embodiment of a pump that uses multiple heating elements 212, 222, 232 to pump fluid from an inlet 210 through a pump chamber 205 and out through an outlet 220. An inlet heating element 212 is located in proximity to the inlet 210 and forms an inlet bubble valve, and an outlet heating element 232 is located in proximity to the outlet 210 and forms an outlet bubble valve. Fluid can be pumped through the structure of FIG. 4 in a similar fashion as described with respect to FIGS. 3A–3H. The inlet heating element 212 and the outlet heating element 232 of FIG. 4 are smaller than the similar heating elements 112, 132 of FIGS. 3A–3H. The smaller heating elements 212, 232 are able to open and close the bubble valve faster than larger heating elements, i.e., heat up to form a bubble to block fluid flow and cool off to allow fluid flow, respectively. The smaller heating elements 212, 232 also use less energy than larger heating elements.

Figure 5:
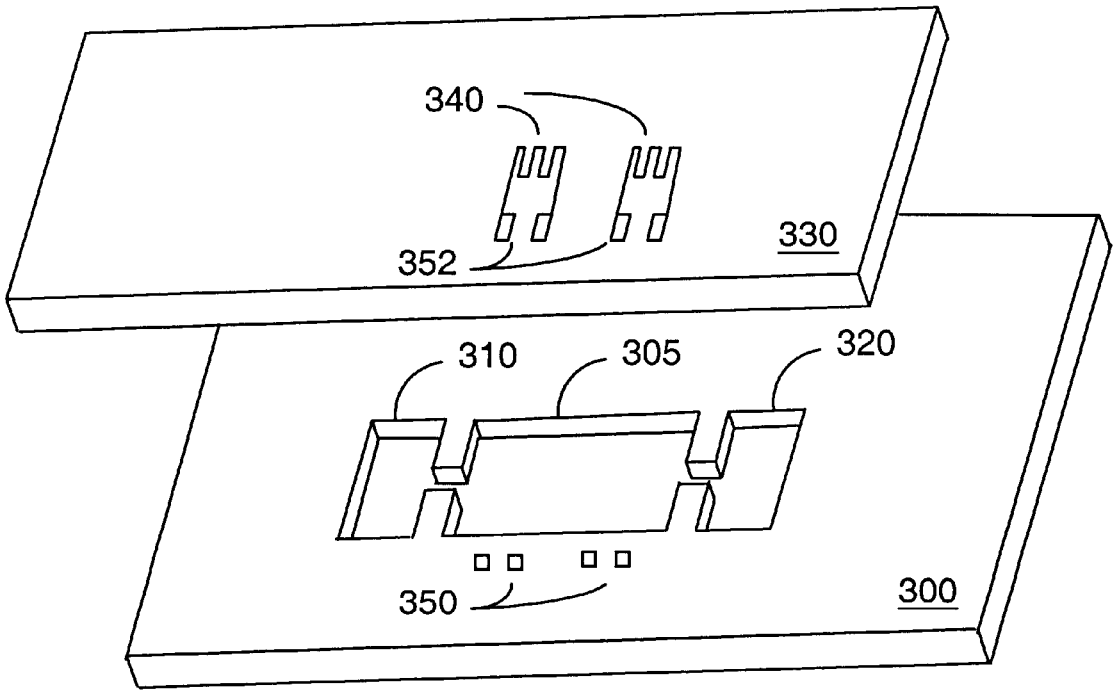
FIG. 5 is a 3-D diagram that shows an example bubble pump.

FIG. 5 is a 3-D diagram that shows an example bubble pump. In one embodiment, the chamber 305, inlet 310, and outlet 320, are formed in a substrate 300. The substrate may be made from any of materials such as glass, ceramic, plastic, or silicon. In one embodiment, the chamber 305 may be milled, etched, or molded into the desired shape.

In one embodiment, a cover 330 is formed over the chamber 305, inlet 310, and outlet 320. Two or more heating elements 340 are used to create the bubbles. In one embodiment, the heating elements 340 comprise serpentine aluminum; however, various other metals may be used to heat the fluid. The heating element is appropriately picked to provide a heated temperature that exceeds the boiling point of the fluid to be pumped, in order to produce the previously described bubbles.

In one embodiment, the cover 330 is a pyrex glass that can accommodate the high temperature of the heating elements 340. Other materials such as silicon, or ceramic may alternatively be used as a cover 330.

In one embodiment, one or more through-holes 350 in the substrate 300 allow electrical connectivity to contacts 352 of the heating elements 340. In one embodiment, a controller coupled to the heating element 340 is calibrated to generate the appropriate sized bubble to accomplish the above described pumping. If a transparent cover 330 is used, then the controller can be visually calibrated to generate the appropriate sized bubbles.

Thus, a bubble peristaltic pump and method of using the same is disclosed. However, the specific embodiments and methods described herein are merely illustrative. For example, although the pump chamber was described with respect to a single inlet and outlet, the concepts described are easily extendable to a pump chamber having multiple inlets and outlets. Numerous modifications in form and detail may be made without departing from the scope of the invention as claimed below. The invention is limited only by the scope of the appended claims.

What is claimed is:

1. A pump comprising:

a chamber having an inlet and an outlet;

a first heating element located in proximity with the inlet, the first heating element configured when heated to produce a first stationary bubble capable of completely blocking the inlet;

a second heating element located in proximity with the outlet, the second heating element configured when heated to produce a second stationary bubble capable of completely blocking the outlet.

2. The pump of claim 1, wherein the first heating element and the second heating element comprise aluminum.

3. The pump of claim 1, wherein the chamber comprises silicon.

4. The pump of claim 1, wherein the chamber comprises glass.

5. The pump of claim 1 further comprising:

a fluid having a boiling point low enough for the first heating element and the second heating element to form a bubble in the fluid.

6. The pump of claim 1, wherein the inlet and the outlet are shaped symmetrically.

7. The pump of claim 1 further comprising:

a third heating element located between the first heating element and the second heating element, the third heating element configured when heated to produce a third stationary bubble capable of blocking the chamber.

8. The pump of claim 7, wherein the third heating element is larger than the first heating element and the second heating element.

9. The pump of claim 8, wherein the third heating element is in proximity to a portion of the chamber having larger dimensions than chamber dimensions in proximity to the first heating element and the second heating element.

10. A method of pumping a fluid through a chamber having an inlet and an outlet, the method comprising:

creating a first bubble to block the inlet; and creating one or more second bubbles to expel fluid through the outlet;

block the outlet with at least a portion of the one or more second bubbles;

reducing the size of the first babble to unblock the inlet to allow fluid to flow in through the inlet;

blocking the inlet wit a third bubble; and unblocking the outlet by reducing the size of the one or more second bubbles.

11. The method of claim 10, wherein the blocking the inlet and the unblocking the outlet are performed during at least partially overlapping times.

12. The method of claim 10, wherein the third bubble is an enlargement of the first bubble.

13. The method of claim 10, further comprising:

systematically heating the first and second heating elements to peristaltically displace fluid in the chamber to create a net flow of fluid from the inlet to the outlet.

14. A method of pumping a fluid through a chamber having an inlet and an outlet, the method comprising:

heating a first heating element to create a first bubble within the chamber to substantially block the inlet;

heating a second heating element to create a second bubble within the chamber to expel fluid through the outlet;

heating a third heating element to create a third bubble to substantially block the outlet.

15. The method of claim 14 wherein the third bubble is an expansion of another bubble.

16. The method of claim 14 further comprising allowing the chamber to be refilled with fluid by:

allowing the first heating element and the second heating element to cool; and then reheating the first heating element to block the inlet.

17. The method of claim 16 further comprising expelling more fluid from the chamber by:

allowing the third heating element to cool;

reheating the second heating element; and reheating the third heating element to block the outlet.

18. The method of claim 14, further comprising:

systematically heating the first, second, and third heating elements to peristaltically displace fluid in the chamber to create a net flow of fluid from the inlet to the outlet.

* * * * *